US005571281A

United States Patent [19]

Allen

[11] Patent Number: 5,571,281

[45] Date of Patent: Nov. 5, 1996

[54] AUTOMATIC CEMENT MIXING AND DENSITY SIMULATOR AND CONTROL SYSTEM AND EQUIPMENT FOR OIL WELL CEMENTING

[76] Inventor: Thomas E. Allen, 4045 N. Garnett, Tulsa, Okla. 74116

[21] Appl. No.: 598,908

[22] Filed: Feb. 9, 1996

[51] Int. Cl.[6] ..... B01F 15/02; B28C 9/04

[52] U.S. Cl. ..... 366/2; 366/163.1; 366/178.1; 366/178.3

[58] Field of Search ..... 366/2, 3, 4, 5, 366/6, 14, 15, 27, 28, 29, 40, 131, 132, 136, 137, 137.1, 159.1, 163.1, 163.2, 165.1, 167.1, 178.1, 178.3

[56] References Cited

U.S. PATENT DOCUMENTS

| | | | |
|---|---|---|---|
| 2,743,909 | 5/1956 | Lawlor | 259/42 |
| 3,201,093 | 8/1965 | Smith . | |
| 3,298,669 | 1/1967 | Zingg | 259/4 |
| 3,542,342 | 11/1970 | Barron | 259/4 |
| 3,741,533 | 6/1973 | Winn . | |
| 4,007,921 | 2/1977 | Zingg | 259/151 |
| 4,643,582 | 2/1987 | Ricciardi | 366/178.1 |
| 4,778,280 | 10/1988 | Brazelton | 366/136 |
| 4,781,467 | 11/1988 | Williams | 366/163.1 |
| 4,863,277 | 9/1989 | Neal et al. | 366/137 |
| 4,915,505 | 4/1990 | Arribau et al. | 366/136 |
| 4,919,540 | 4/1990 | Stegemoeller et al. | 366/132 |
| 5,018,868 | 5/1991 | Baillie | 366/10 |
| 5,027,267 | 6/1991 | Pitts et al. | 364/172 |
| 5,039,227 | 8/1991 | Leung et al. | 366/137 |
| 5,046,855 | 9/1991 | Allen et al. | 366/137 |
| 5,103,908 | 4/1992 | Allen | 166/285 |
| 5,114,239 | 5/1992 | Allen | 366/6 |
| 5,289,877 | 3/1994 | Naegele et al. | 166/285 |
| 5,355,951 | 10/1994 | Allen | 166/250 |

*Primary Examiner*—Robert W. Jenkins
*Attorney, Agent, or Firm*—Head, Johnson & Kachigian

[57] ABSTRACT

A cement mixing and slurry density control system utilizes an improved eductor mixer for particular use in a cementing process for an oil or gas well.

18 Claims, 6 Drawing Sheets

AUTOMATIC CEMENT MIXING AND DENSITY SIMULATOR AND CONTROL SYSTEM AND EQUIPMENT FOR OIL WELL CEMENTING

BACKGROUND OF THE INVENTION

1. Field of the Invention

Broadly, the invention relates to an improved apparatus and method for mixing dry particles with a liquid. Specifically, the invention is directed to apparatus and method which is particularly suitable for both practice simulation and actual use in mixing and recirculating dry cement with water to obtain cement slurries of desired density for use in a particular oil well cementing operation.

2. Background

Utilization of cement within oil wells, particularly, in the cementing of casing therein has been under development since the early 1900's. Two of the purposes of placing cement into the annular space between the casing and the formation are: 1) to support the casing within the well, and 2) to seal off undesirable formation fluids.

Casing is typically secured in the well bore by the cement being mixed at the surface by being pumped down the open center of the casing string and thence back up the annular space which exists between the outer diameter of the casing and the inner diameter of the oil well bore. A displacement fluid, such as drilling mud, is pumped behind the cement to push the cement to the desired location. In many oil and gas well applications it is often necessary to provide cement mixers which will rapidly prepare large quantities of material to be pumped into the well by a batch or continuous process until a sufficient predetermined quantity has been applied. In either case, the process usually begins with the material being pre-prepared by dry blending and water being added at the well site. Batch mixing is one form of system to obtain a satisfactory slurry, but batch mixing requires an initial outlay of a large amount of equipment, people and space. In offshore operations, space and weight capacity are expensive. Batch mixers use valuable space and add to rig weight. Typically, large tanks with rotary paddle type mixers, although being able to adequately perform the mixing operations, have not been efficient in terms of space, numbers of people required or equipment costs where large volumes of mixing must be done at the well site.

For the continuous process, there must be continuous monitoring of and adjustments to the mixed slurry in order to insure that it will have the proper qualities and characteristics once it has been placed into the well and into the annular space between the casing and the well bore.

Probably one of the most critical elements of oil well cementing is the maintenance of the required density and the capability of changing that density during the cementing operation as needed. One quality measurement of a cement slurry is its conformance to the desired density. Thus, the density must be controlled especially where the cement will be positioned opposite producible geologic formations which will need to be perforated so that the oil or gas from the zone or zones will flow into the casing for production. Density of the cement mixture may have differing characteristics at different well sites of geological zones, i.e., it must be suitable for the downhole environment where it is to be used. For example, varying depths, downhole pressures, temperatures and geological formations may call for cement slurries of different densities. In other instances, it may be necessary to utilize cement of a particular density to seal off a water table encountered in the well bore, or there may be porous formations or cavities encountered which may need to be filled and plugged requiring the use of other additives or fillers during the cementing process. As a result, these factors require the density and makeup of the cement to be constantly monitored and controlled. All of these characteristics must be designed and accounted for, typically at the well site during the makeup of the cement slurry.

Slurry density is controlled by adjusting the ratio of cement dry blends and mix water. If the bulk blend is constant, a less than required amount of water can result in too high density and result in an insufficient volume of slurry being placed into the well. Also, viscosity of the slurry will be high and, therefore, pumping pressures may be excessive and could cause a loss of circulation in certain formations. The quality of the cement slurry placement process involves the completeness of the mixing process and the pumping rate which can affect the bond between the casing and the well bore. In addition, cement and additives such as loss circulation materials and weighting materials need to be thoroughly mixed to prevent separation or premature setting.

Many types of cement mixers have been known in the prior art. For example, jet-type mixers and vortex mixers such as those disclosed in U.S. Pat. Nos. 3,201,093 and 3,741,533 have been used with considerable success but have not necessarily been successful in continuously mixing cement slurries while maintaining substantially constant density, or quickly changeable density for different application during the cementing of the oil well casing. Such jet or eductor type mixers worked reasonably well when slurry designs were simple. With the more enhanced slurry designs of today, the jet mixer cannot adequately mix these slurries and does not allow adequate density control for today's specified tolerances.

Continuous recirculating mixers were developed to overcome some of the deficiencies of the jet type and batch mixers. These systems mix dry cement and water in an inlet mixer, the output going to a tank for agitation with excess slurry flowing over a weir to an adjustment tank, which may be agitated, thence pumped into the well. Typically, a portion of the mixed slurry was recirculated from the mixing tank and directed back into a modified jet mixer. Thus, newly delivered dry bulk cement was wetted both by water and recirculated cement. This provided additional mixing energy that enabled the satisfactory mixing of higher slurry densities. These type mixers were first introduced during the early 1970's. Since that time, cement slurry design has evolved into the use of more complex slurries that continuous mixing systems are unable to achieve. Thixotropic slurries with very low "free water" requirements have evolved for the deep, high temperature, high pressure gas wells. It seems as though the industry is constantly testing the ability of mixers by developing even more difficult to mix slurries. Furthermore, tighter tolerances on slurry density control are being developed. Density, however, cannot be controlled if the mixing process is not adequate. Hence, a satisfactory mixing means is the key to successful control over slurry density in a continuous process.

SUMMARY OF THE INVENTION

It is an object of this invention to provide an apparatus and method for overcoming the shortcomings of the prior art processes and apparatus and provide an improved cement mixing apparatus and control system that will permit greater and substantially immediate control over the density of the resulting mix prior to its placement within the well.

A further object of the invention is to provide an apparatus wherein the desired density can be changed fairly easily and rapidly as changes in slurry design for a particular well cementing operation are encountered.

A yet further object of the invention is to provide a continuous cement mixing system wherein dry bulk cement is introduced into a special high energy mixer powered by a high pressure water source and which includes means for recirculating cement slurry from a mixing tank or tanks. The process is performed upon an apparatus which may be mounted upon a vehicle capable of travel to the oil well site.

A further object of the invention is to provide a high energy mixing apparatus in the form of an eductor, the outlet of which is directed to a slurry mixing tank. The eductor is comprised of the central water conduit and nozzle for controllably injecting water under pressure into the outlet of the eductor. A casing surrounds the nozzle creating a first annular space around the conduit and nozzle within which dry bulk cement is controllably introduced. A second baffled annular space is created between the casing and the eductor conduit wherein recirculated slurry is angularly introduced downstream of the nozzle through spaces between the baffles. The invention thus provides a continuous mixing system. A changeable cement density control system is provided by controlling the rate of flow of water and bulk cement.

A further object of the invention is to provide a process for continuous mixing and cement density control utilizing pre-programmed microprocessor (computer) controls therewith for achieving desired cement densities for a particular oil well cementing job. In addition, the microprocessor control includes means to provide a simulated cementing process for training or as a system functional check prior to the actual cementing job.

A further object of the invention is to provide a continuous automatic mixing and cement density control system utilizing separate mixing tanks with the outlet from a high energy eductor type mixer, the outlet of which can be controllably directed to a plurality of mixing tanks for achieving a plurality of separated desired densities as may be required in oil well cementing operations.

These and other objects will become more apparent upon further reference to the drawings, detail description and claims submitted herewith.

DETAILED DESCRIPTION OF THE PREFERRED EMBODIMENTS

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

Figure 1:
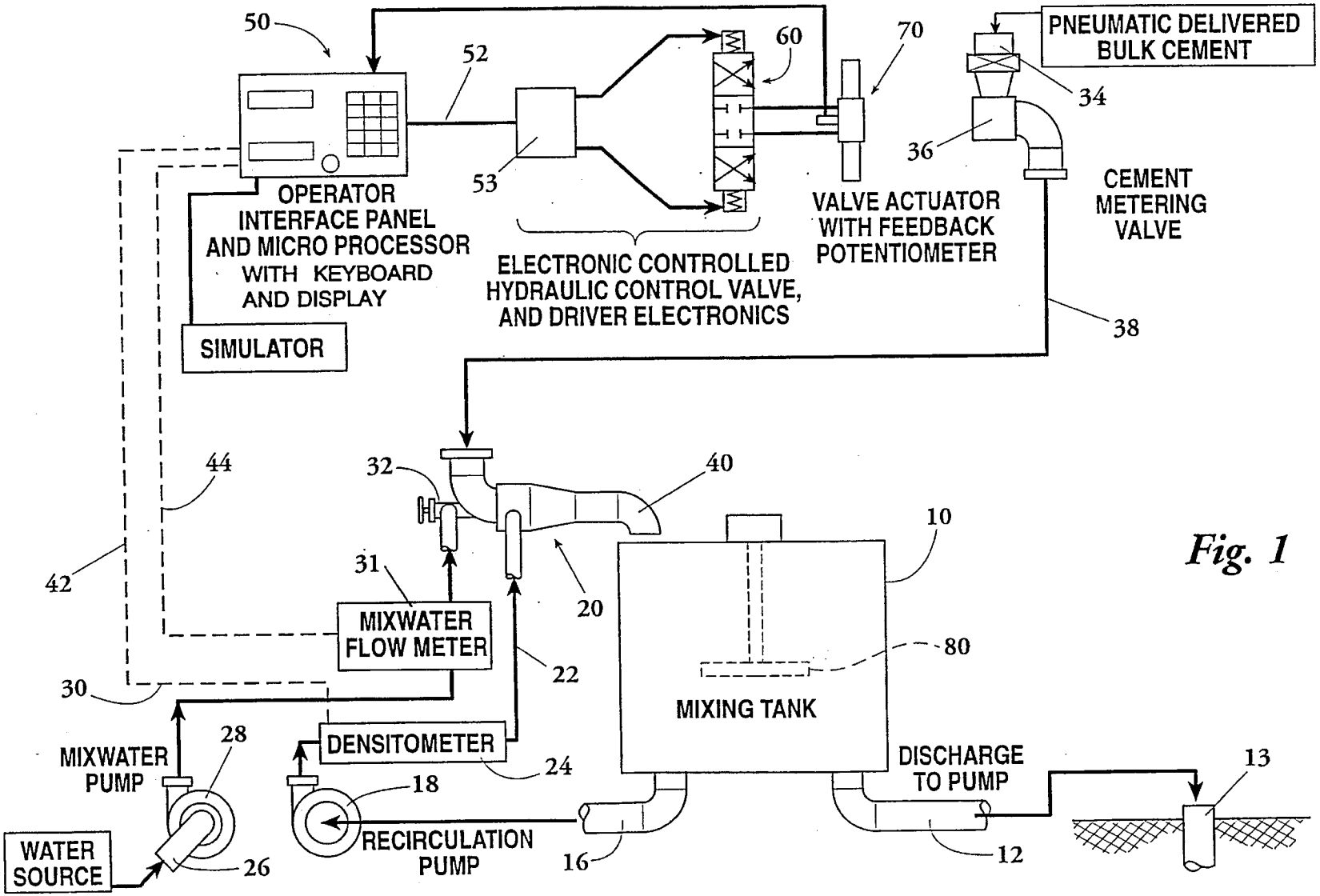
FIG. 1 is a schematic view of the mixing and control functions of the invention.

The overall system of the invention is found in FIG. 1 which comprises a mixing tank 10, which may be similar to a conventional displacement tank as used in performing cementing operations at oil well sites. Displacement tanks are ordinarily used to hold a fluid which is forced behind a column of cement slurry to push the slurry to a desired location in the well bore. Such tanks have means for accurate determinations of volume and, in this instance, are used as a mixing and cement slurry holding tanks during the oil well cementing process. Typically, there are two such displacement tanks, each with a capacity of 10 barrels. Mixing tank 10 typically includes an agitator 11. An outlet 12 from the mixing tank is introduced into the inlet of a high pressure pump, such as a triplex positive displacement type, generally designated by the numeral 14 in FIG. 2, the outlet of which is then directed into the well 13 in the manner well known in the art. The mixing tank 10 contains a further outlet 16 to inlet of a recirculation pump 18, the outlet of which enters the high energy mixer, generally designated by the numeral 10, via conduits 22 and 25 (see FIG. 3). A densitometer 24 is positioned within the conduit 22 for supplying information to the operational controls in order to achieve the proper density at that particular time during the cementing operation. Water entering via conduit 26 flows into the inlet of a mix/water pump 18, the outlet of which forces the water under pressure via conduit 30 to the water inlet 32 of the high energy mixer which is described in FIGS. 4 and 5. Dry bulk cement is delivered pneumatically to conduit 34 being controlled by a metering valve 36 into conduit 38 which enters the high energy mixer 20 as more aptly described in FIG. 4. The outlet 40 from the high energy mixer enters the mixing tank 10.

Control of the continuous mixing system occurs automatically through the use of an operator interface panel (OIP) and microprocessor, generally designated by the numeral 50, which is pre-programmed with the input data as to the desired density of the cement slurry being discharged to the pump at the particular time during the process. The microprocessor is preferably a digital computer which is connected to the densitometer 24 by electrical connection 42 and is further connected to the mix/water flow meter 31 by electrical connection 14. The computer is preprogrammed with the appropriate density and time data for the cementing process. Density control is achieved from electrical signals received from the densitometer 24 and the flow meter 31 combined with control of the cement metering valve and/or water to achieve the proper cement slurry density from the outlet 40 of the high energy mixer. The computer is preprogrammed based upon the particular cementing job parameters including density, yield, water requirements, water specific gravity and sack weight. This data is used to make calculations which are ultimately used to control the dry bulk cement. The computer electronically controls the hydraulic control valve system, generally designated by the numeral 60, by way of electrical conduit 52 to a driver card 53. The hydraulic system controls a hydraulic rotary actuator with feedback potentiometer, generally designated by the numeral 70, which in turn controls the opening and closing of a cement meteting valve 36. Density and other data is stored in the microprocessor as averages taken at 10 second intervals for up to 100 hours. Additional data replaces the first data entered (first in, first out). This data, which is stored in an ASCII format, can be "Down Loaded" through a RS-232 port connection on the from of the "OIP". It can then be imported into a spread sheet for plotting and analysis.

Figure 2:
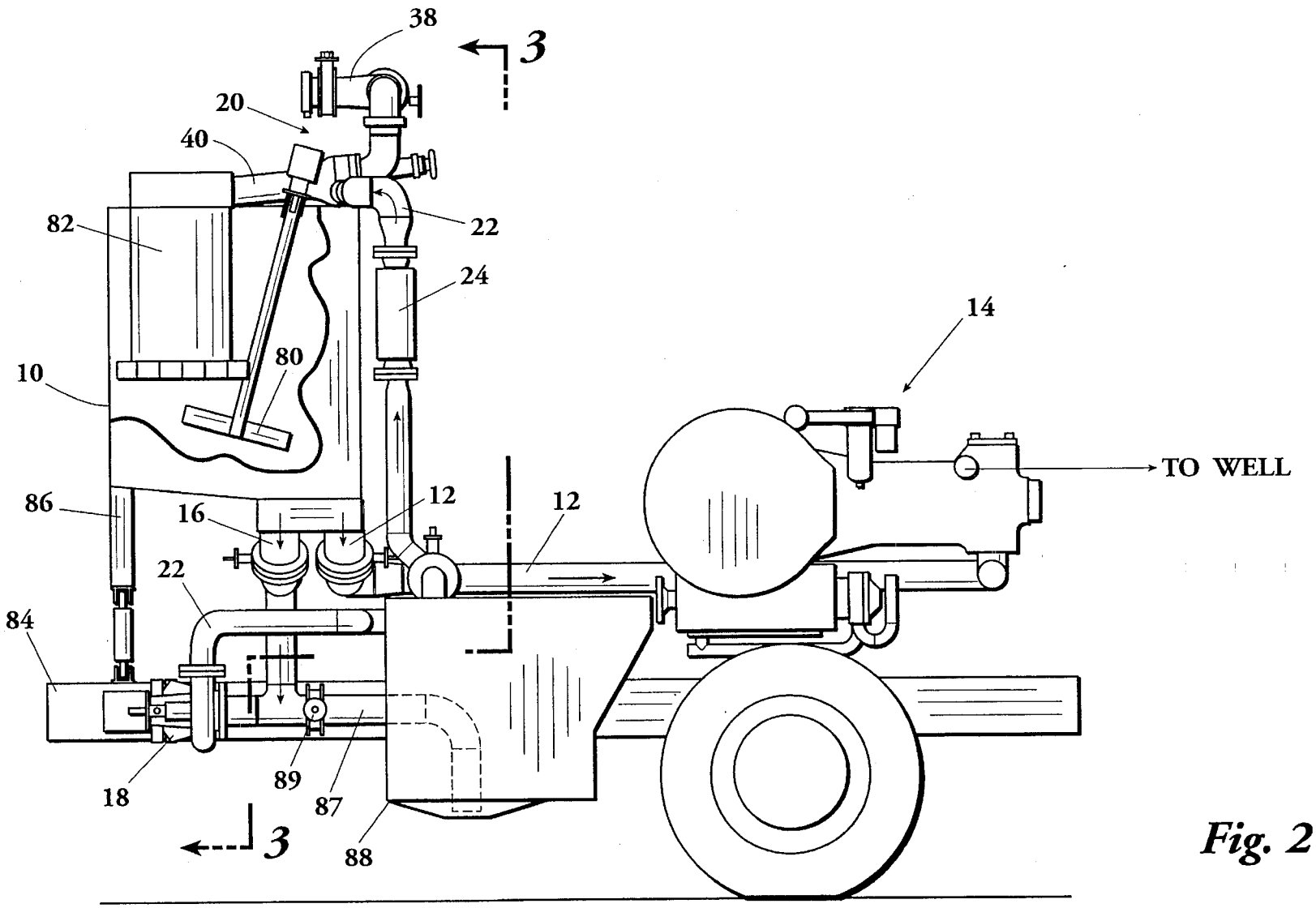
FIG. 2 is a side elevational view of a vehicle incorporating the apparatus and processes of this invention.

FIG. 2 represents a partial view of the apparatus of this invention installed upon a wheeled vehicle or trailer. In this view, mixing tank 10 includes therein a paddle wheel mixer or agitator 80, the inlet to the tank being forced through a centrifugal separator 82 for removing any entrained air and other gases from the bulk cement. The mixing tank 10 is supported on the chassis 84 of the vehicle by appropriate support legs 86. The vehicle contains an auxiliary mixing tank 88 for receiving slurry from an alternate jet mixer located at ground level, not shown. Conduit 87, controlled by valve 89, enters the recirculation pump 18 for entry into the system as needed. Slurry from the tank 10 exits via conduit 12 to the triplex pump 14, the outlet of which is directed to the well. Recirculating slurry passes through conduit 16 either from tank 10 (and/or) the auxiliary mixing tank 88 into the inlet of recirculation pump 18 thence via conduit 22 through densitometer 24 and conduit 22 into the high energy mixer 20. The outlet 40 enters tangentially into the centrifugal separator 82.

Figure 3:
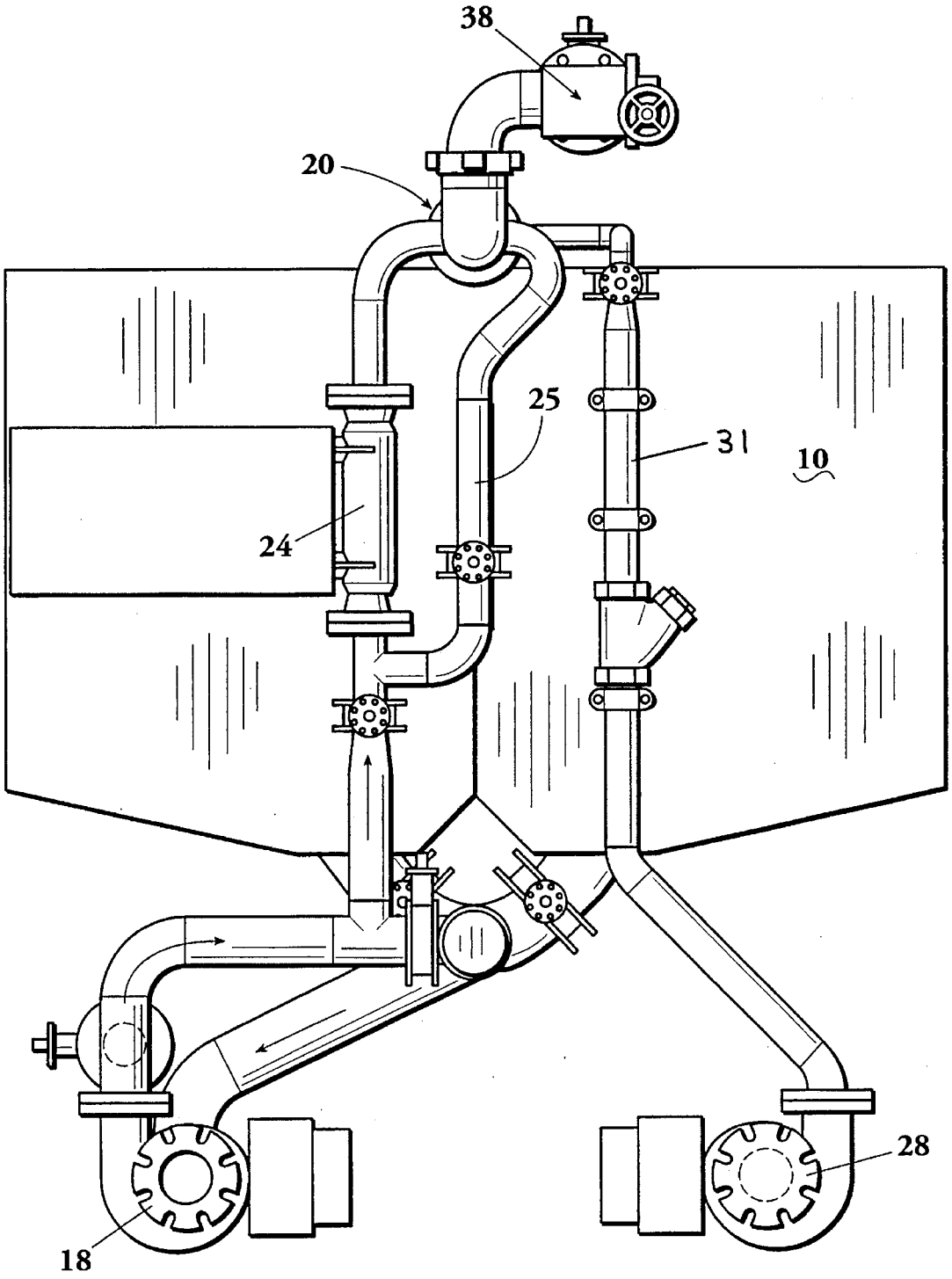
FIG. 3 is a side elevational view of the recirculating slurry mixing system.

Another view as shown in FIG. 3 shows the conduit and system comprised of mix/water pump 28, the outlet of which sends high pressure water through flow meter 31 to the central conduit 90 and nozzle 92 of high energy mixer 40. (See FIG. 4.) Recirculated slurry is pumped and drawn into the sides of the high energy mixer as hereinafter described.

Figure 4:
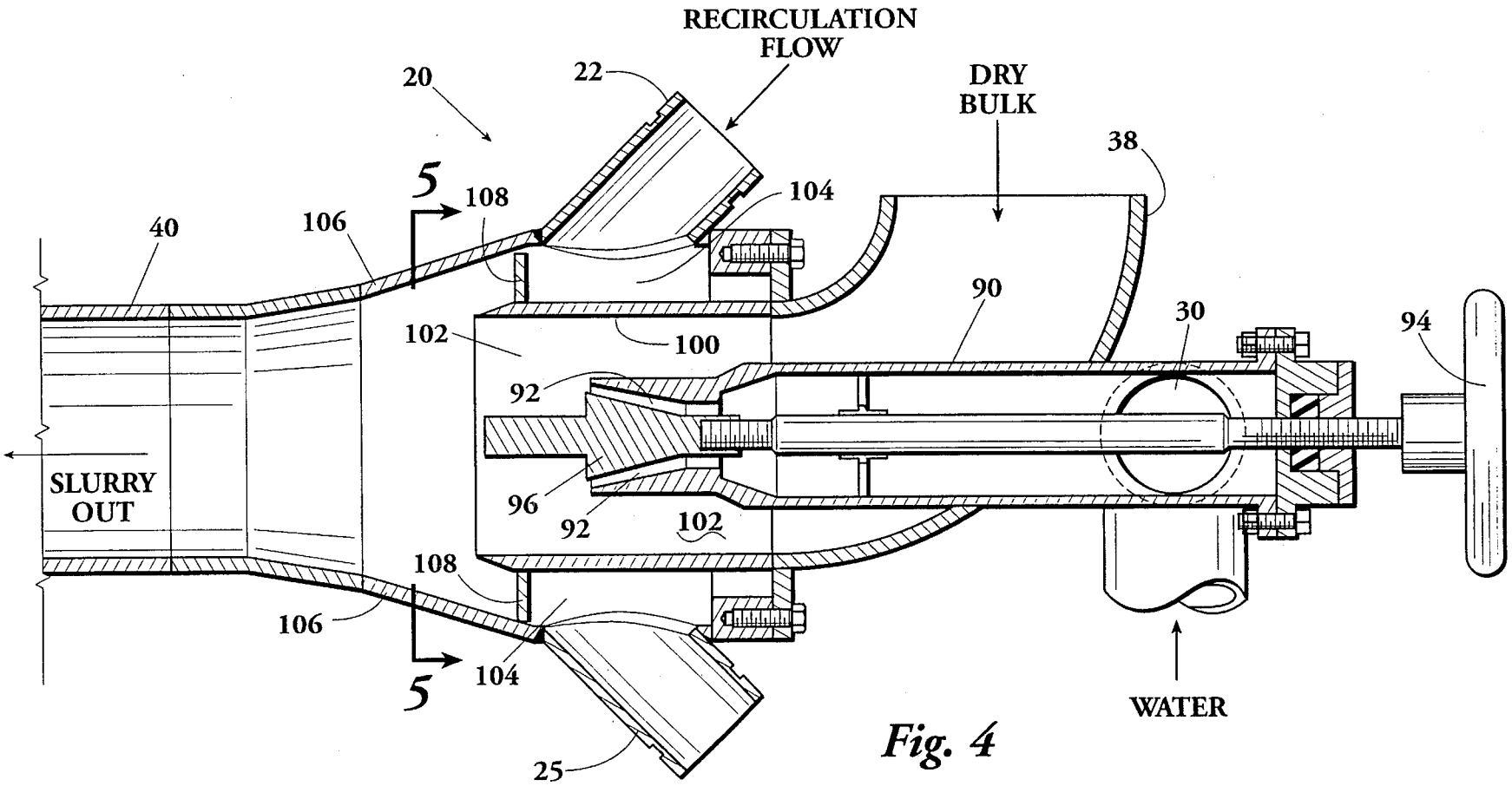
FIG. 4 is a sectional view of the high energy mixing apparatus used in this invention.

FIG. 4 describes the details of the high energy 20 mixing device of this invention and is of an eductor form of apparatus. High pressure water enters via conduit 30 into the central water conduit 90 and exits outwardly under high velocity through annular port 92. The size of port 92 is controlled by, as for example, a hand wheel 94 to which the cone-shaped restriction vane 96 is movable inwardly and outwardly by way of control rod 98. The valve 96 is designed to provide equal increases in water flow per each turn of the handwheel 94. The dry bulk cement entry conduit 38 terminates within the eductor beyond the end of the nozzle opening 92 formed by casing 100 which creates the coaxial annular space 102 through which the dry bulk cement enters and becomes homogenized, i.e., entrained and mixed with the high energy water stream through nozzle opening 92 and/or mixed with the recirculating slurry as described hereafter. Dry cement is caused to be pumped, usually under pneumatic pressure, from bulk storage units, not shown, which are positioned at the well site and connected to the high energy mixer 20 via conduits 34 and 38.

Figure 5:
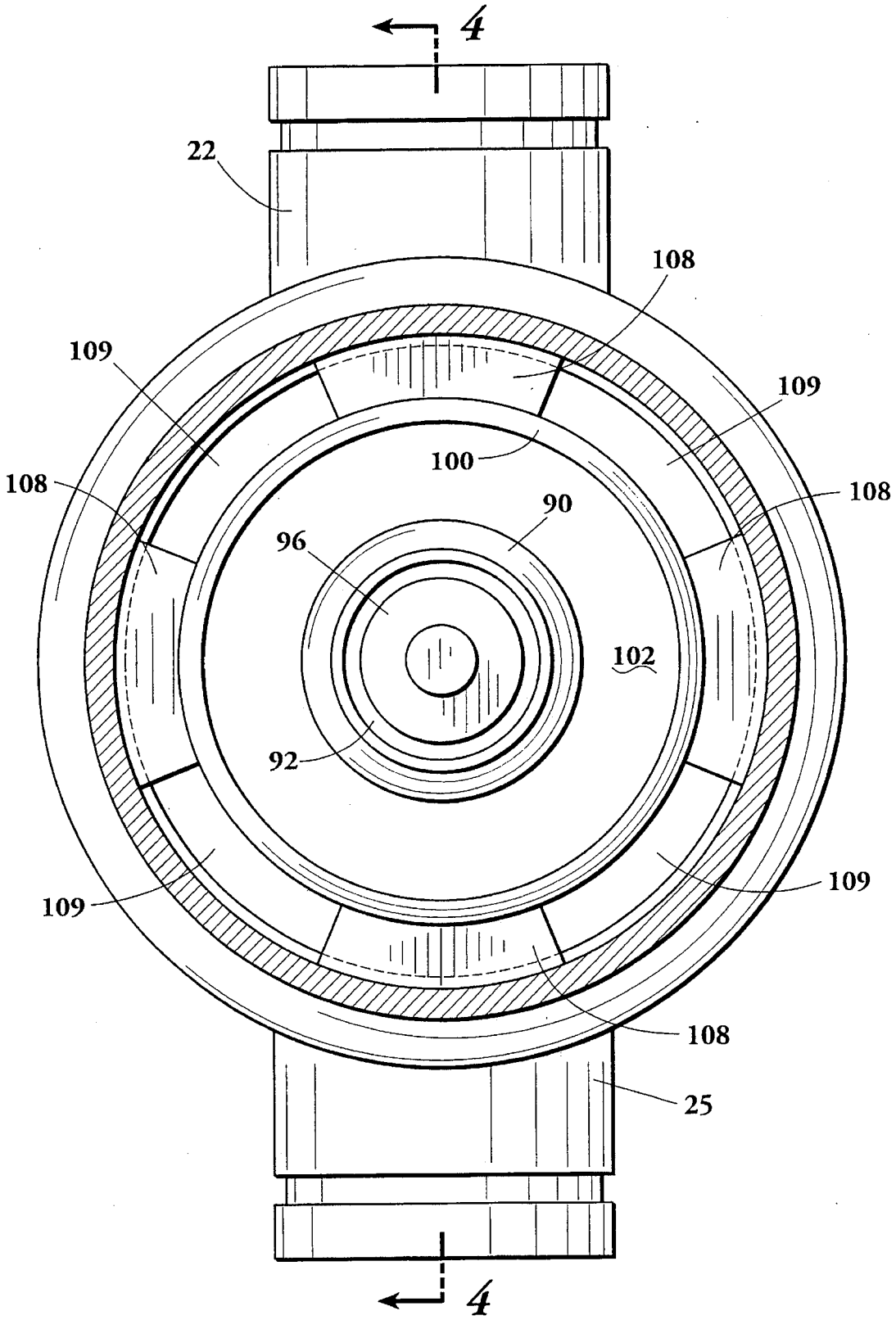
FIG. 5 is a sectional view taken along the line 4—4 of FIG. 3.

A second coaxial annular space 104 is created between the casing 100 and the eductor body 106 being supported by spacer baffles 108 to receive the flow of recirculated cement slurry via conduits 22 and 25. As best shown in FIG. 5, the separated spacer baffles 108 define angularly spaced openings 109 which further enhance mixing.

In many oil well cementing operations it is desirable to provide means to introduce cement slurries of different densities, characteristics or quality at different times during the process. For example, in many situations a "lead slurry" of a given density is pumped into the well casing, thence upwardly to fill the upper annular space created between the casing and the well bore. This is followed by "tail slurry" of another density that will fill the lower annular space usually adjacent the producing formation. The design of tail slurry is usually formulated to provide greater strength and thus, will be appropriate for those producing formations that may be perforated to release and permit flow of the production fluids.

Figure 6:
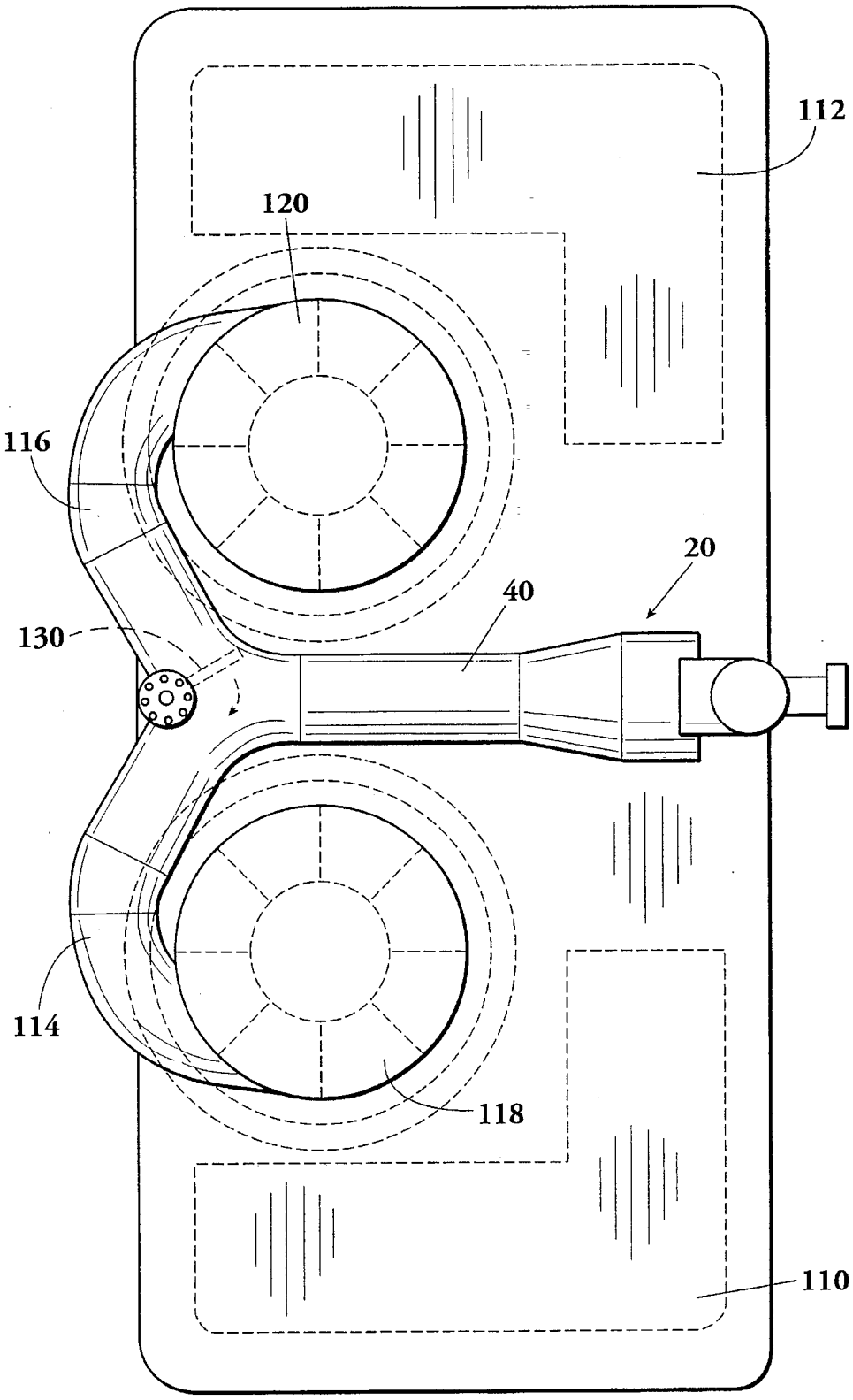
FIG. 6 is a top elevational view of a two tank mixing system for creating cement mixes of distinguishing characteristics and/or demities.

The embodiment of FIG. 6 permits the preparation of, as for example, a lead slurry supply tank 110 and a separate tail slurry supply tank 112. The outlet from the high energy mixer 20 can be directed via conduit 114 to the lead slurry tank 110 and/or to the tail slurry supply tank 112 via conduit 116. A valve blade 130 controls the direction of flow. Each conduit 114 and 116 being directed tangentially into respective air separator 118 and 120.

What is claimed is:

1. Apparatus for mixing and maintaining density of cement slurries for a well comprising:

a vehicle transportable to a site adjacent said well;

a first slurry mixing tank; said tank including means to mix said slurry therein;

an eductor conduit, the outlet of which enters said first slurry mixing tank, said eductor comprised of:

a central water conduit and nozzle for controllably injecting water under pressure to the outlet of said eductor;

a casing surrounding said nozzle creating a first annular space around said conduit and nozzle;

means to introduce dry cement into said first annular space;

a second annular space between said eductor conduit and said casing; and means to recirculate slurry from said first mixing tank to said second annular space.

2. The apparatus of claim 1 including a densitometer in said contact with said recirculated slurry.

3. The apparatus of claim 1 including a flowmeter in said water conduit.

4. The apparatus of claim 1 including a gas separator in said first mixing tank, the inlet of what is connected to the outlet of said eductor conduit.

5. The apparatus of claim 1 wherein there is a second slurry mixing tank and first and second controllable outlet conduits communicable with the outlet of said eductor conduits to said respective first and second mixing tanks.

6. The apparatus of claim 5 including a gas separator in each of said first and second mixing tanks, the inlet of each separator in communication with the respective first and second outlet conduits.

7. Apparatus of claim 2 including an automatic control system;

said system having automated control means to:

input a desired density of cement slurry from said outlet of said eductor;

receive density information from said densitometer;

compare said desired density with said information; and control the amount of dry cement added to the recirculate slurry in said eductor to achieve said desired density.

8. Apparatus of claim 7 wherein said automated control means comprises a digital computer.

9. The apparatus of claim 8 wherein said computer includes means to conduct a simulated density control system for given well parameters without actual mixing taking place.

10. Apparatus of claim 1 wherein said casing surrounding said nozzle extends beyond the end of said nozzle and beyond an inlet of said recirculate to said second annular space.

11. A method for mixing cement slurries comprising:

mixing said slurry in a first tank;

recirculating said slurry from said first tank to an annular space co-axially surrounding a nozzle chamber creating a mixed slurry of said recirculated slurry with dry cement and water by introducing dry cement into said nozzle chamber, and introducing controllable amounts of water to a coaxial nozzle and returning said mixed slurry from an outlet of said nozzle to said first tank.

12. The method of claim 11 comprising the step of selectively returning said mixed slurry to a second tank.

13. The method of claim 11 including creating a desired density for said recirculating slurry, and controlling the amount of said dry cement and water to maintain said density.

14. An eductor for mixing pulverant material with a liquid to form a slurry comprising:

an eductor housing having a central axis and a downstream outlet conduit for directing resulting slurry into a holding tank;

a central axial conduit and nozzle for controllably injecting liquid under pressure toward said outlet conduit;

a casing surrounding said nozzle creating a first annular space around said central conduit and nozzle;

means to introduce dry pulverant material into said first annular space;

a second annular space between said eductor housing and outlet conduit; and means to recirculate slurry form said holding tank into said second annular space.

15. The eductor of claim 14 including spaced baffles in said second annular space creating a plurality of spaced openings therebetween for said recirculate slurry to pass through.

16. The eductor of claim 15 wherein said spaces are on 45° centers from vertical and horizontal centerlines.

17. The eductor of claim 14 wherein said means to recirculate slurry is directed downstream at an acute angle to said central axis.

18. The eductor of claim 17 wherein said acute angle is 22°.

* * * * *